US005862704A

United States Patent [19]

Seljestad

[11] Patent Number: 5,862,704

[45] Date of Patent: Jan. 26, 1999

[54] RETAINER MECHANISM FOR AN AXIAL PISTON MACHINE

[75] Inventor: Gregory A. Seljestad, Peoria, Ill.

[73] Assignee: Caterpillar Inc., Peoria, Ill.

[21] Appl. No.: 753,621

[22] Filed: Nov. 27, 1996

[51] Int. Cl.[6] ..... F16H 23/06

[52] U.S. Cl. ..... 74/60; 91/499; 92/71

[58] Field of Search ..... 74/60; 92/71; 91/499; 417/269; 411/155, 156, 544

[56] References Cited

U.S. PATENT DOCUMENTS

| | | | |
|---|---|---|---|
| 3,246,577 | 4/1966 | MacIntosh | 74/60 |
| 3,611,879 | 10/1971 | Alderson | 91/507 |
| 3,641,829 | 2/1972 | Reynolds | 74/60 |
| 3,933,082 | 1/1976 | Molly | 91/499 X |
| 3,996,841 | 12/1976 | Gostomski, Jr. | 91/499 |
| 4,615,257 | 10/1986 | Valentin | 91/499 |
| 4,771,676 | 9/1988 | Matsumoto et al. | 92/71 |
| 5,046,403 | 9/1991 | Riedhammer | 92/57 |
| 5,249,507 | 10/1993 | Kawahara et al. | 92/57 |
| 5,279,205 | 1/1994 | Carlson, Jr. et al. | 91/499 |
| 5,381,724 | 1/1995 | Kawahara et al. | 92/71 X |
| 5,520,088 | 5/1996 | Dixen | 92/71 |
| 5,730,042 | 3/1998 | Engel | 92/71 X |

*Primary Examiner*—Rodney H. Bonck
*Assistant Examiner*—Ankur Parekh
*Attorney, Agent, or Firm*—J. W. Burrows

[57] ABSTRACT

A retainer mechanism for an axial piston machine embodies a shoe plate having a plurality of openings defined in a circumferential outer portion thereof to receive a plurality of shoes and a biasing mechanism operative during assembly to apply a force to an inner portion of the shoe plate to hold the plurality of shoes against a swashplate disposed in the axial piston machine. Prior to assembly the shoe plate has a force transferring surface that is generally frusto-conical in shape. During assembly, the biasing mechanism applies a force to the inner portion of the shoe plate to generally flatten the frusto-conical shaped force transferring surface and urge it against a flat bearing surface of the respective shoes.

4 Claims, 3 Drawing Sheets

RETAINER MECHANISM FOR AN AXIAL PISTON MACHINE

TECHNICAL FIELD

This invention relates generally to a retainer mechanism for an axial piston machine, such as a hydraulic piston pump, and more particularly to a retainer mechanism that has a frusto-conical shape prior to assembly in the axial piston machine.

BACKGROUND ART

Retainer mechanisms are well known in the art and primarily function to hold the shoes of a piston assembly against a swashplate of an axial piston machine. A well known problem with axial piston machines is keeping the shoes in contact with the swashplate or keeping the shoes from tipping with respect to the swashplate. Many different styles of shoe plates have been used in an attempt to overcome the above noted problems. A widely utilized design of shoe plates include a circular shape with a flat surface on one side and a plurality of openings defined therein to receive the respective shoes. The flat surface of the shoe plate encircles a neck portion of the respective shoes and contacts an adjacent flat bearing surface. A force is applied to the shoe plate to hold the shoe plate against the respective shoes and thus hold the respective shoes against the swashplate.

One of the problems associated with this type of shoe plate is that the shoe plate is distorted when the force is applied to it. A distorted shoe plate delivers unequal contact on the bearing surface of the shoes and ultimately leads to the shoe tipping. Once the shoe tips, the fluid bearing film between the shoe and the swashplate is broken and catastrophic damage can result due to galling between the materials of the shoe and the swashplate.

The present invention is directed to overcoming one or more of the problems as set forth above.

DISCLOSURE OF THE INVENTION

In one aspect of the present invention a retainer mechanism is provided for use in an axial piston machine. The axial piston machine includes a housing, a swashplate having a circumferential bearing surface, a plurality of shoes having a substantially flat bearing surface and a sliding surface, and a biasing mechanism. The retainer mechanism is biased against the respective shoes to maintain the sliding surface of the shoes in sliding contact with the circumferential bearing surface of the swashplate. The retainer mechanism includes a shoe plate having a circumferential outer portion and an inner portion. The circumferential outer portion has a force transferring surface on one side and a plurality of openings defined therein. Prior to assembly, the force transferring surface has a generally frusto-conical shape. During assembly, a force is applied to the inner portion of the shoe plate by the biasing mechanism to change the frusto-conical shaped force transferring surface of the shoe plate and urge it into intimate contact with the flat bearing surface of the respective shoes.

BEST MODE FOR CARRYING OUT THE INVENTION

Figure 1:
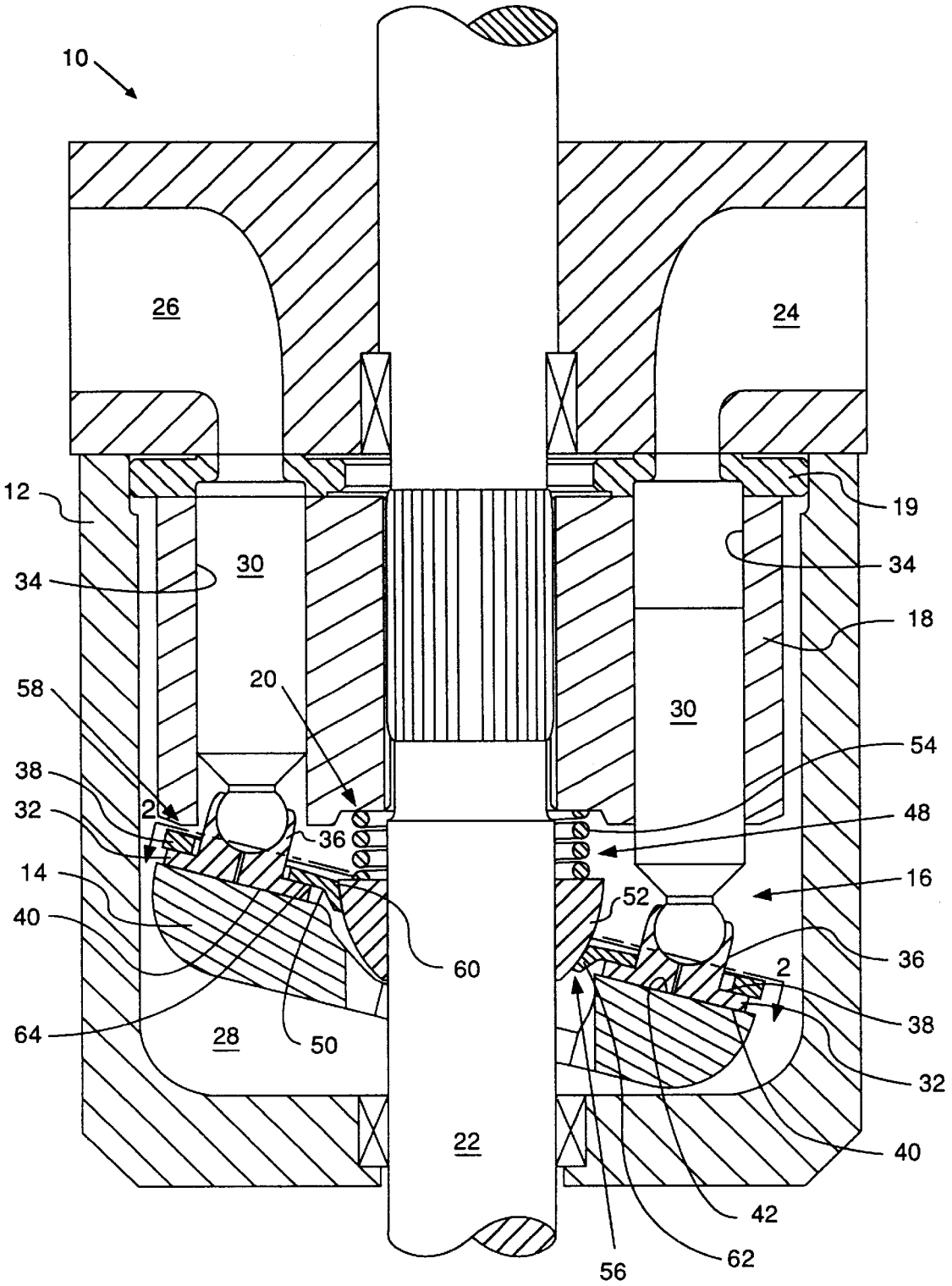
FIG. 1 is a diagrammatic cross-sectional view of an axial piston machine incorporating an embodiment of the present invention.
Figure 2:
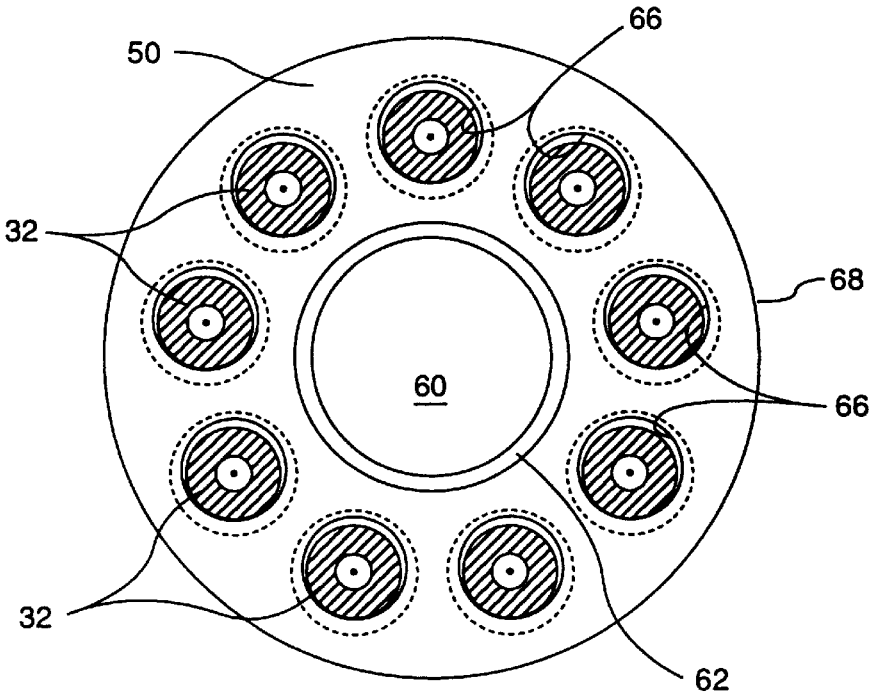
FIG. 2 is a view 2—2 taken from FIG. 1 to better illustrate the top of a shoe plate and the shoes contained therein.

Referring to the drawings and more particularly to FIGS. 1 and 2, an axial piston machine, such as a piston pump 10, is disclosed. The piston pump 10 includes a housing 12, a swashplate 14, a plurality of piston assemblies 16, a barrel 18, a portplate 19, a retainer mechanism 20, and a driving shaft 22.

The housing 12 has an inlet port 24, an outlet port 26 and a cavity 28 defined therein to receive the swashplate 14, the plurality of piston assemblies 16, the barrel 18, the port plate 19 and the retainer mechanism 20. The driving shaft 22 is disposed in the housing 12 and drivingly connected to the barrel 18.

The plurality of piston assemblies 16 each include a piston 30 and a shoe 32 rotatably attached to the piston 30. Each of the pistons 30 is slideably disposed in respective bores 34 defined in the barrel 18. Each of the shoes 32 has a neck portion 36 at one end, a flat bearing surface 38 adjacent the neck portion 36, and a sliding surface 40 at the other end.

The swashplate 14 of the subject embodiment has a circumferential bearing surface 42 on one side and the position of the swashplate 14 relative to the shoes 32 is adjustable in a well known manner. It is recognized that the position of the swashplate 14 could be fixed without departing from the essence of the subject invention.

The respective bores 34 of the barrel 18 is in selective communication through the portplate 19 with the inlet and outlet ports 24,26 as the barrel 18 rotates.

The retainer mechanism 20 includes a biasing mechanism 48 and a shoe plate 50. The biasing mechanism 48 includes a force transferring member 52 in contact with the shoe plate 50 and a spring 54. The spring 54 is disposed between the barrel 18 and the force transferring member 52.

The shoe plate 50 has an inner portion 56 and a circumferential outer portion 58. The inner portion 56 has a passage 60 defined by a flange 62. The circumferential outer portion 58 has a force transferring surface 64 on one side thereof and defines a plurality of openings 66 therethrough. Each of the plurality of openings 66 are generally perpendicular with the force transferring surface 64.

Figure 3:
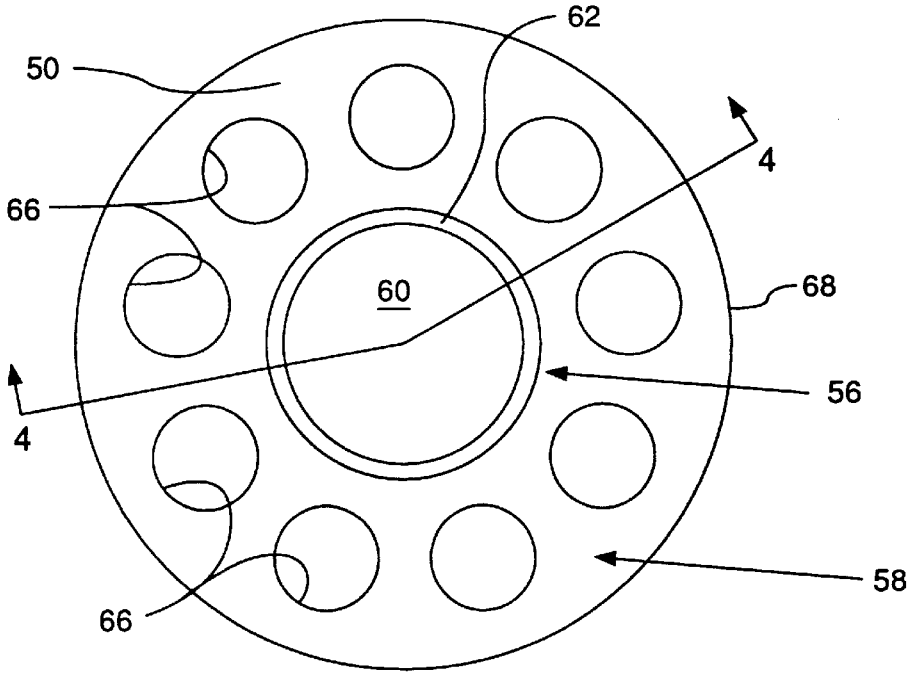
FIG. 3 is a top view of only the shoe plate.
Figure 4:
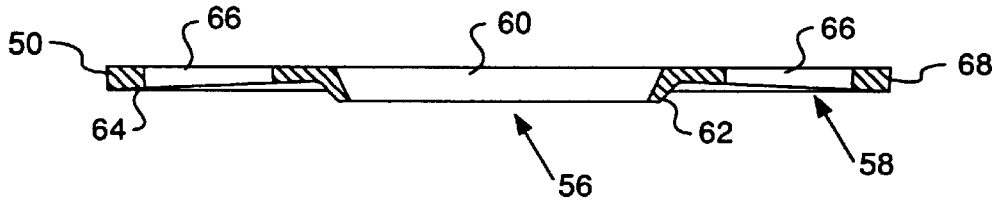
FIG. 4 is a sectional view of the shoe plate taken through the line 4—4 of FIG. 3.

Referring to FIGS. 3 and 4, the circumferential outer portion 58 is circular in shape and has an outermost edge 68. Prior to assembly, the force transferring surface 64 is generally frusto-conical in shape. The thickness of the circumferential outer portion 58 varies from the outermost edge 68 towards the inner portion 56. In the subject embodiment, the thickness is greatest adjacent the outermost edge 68. It is recognized that the thickness of the circumferential outer portion 58 could be generally the same or could be thinnest adjacent the outermost edge 68.

Figure 5:
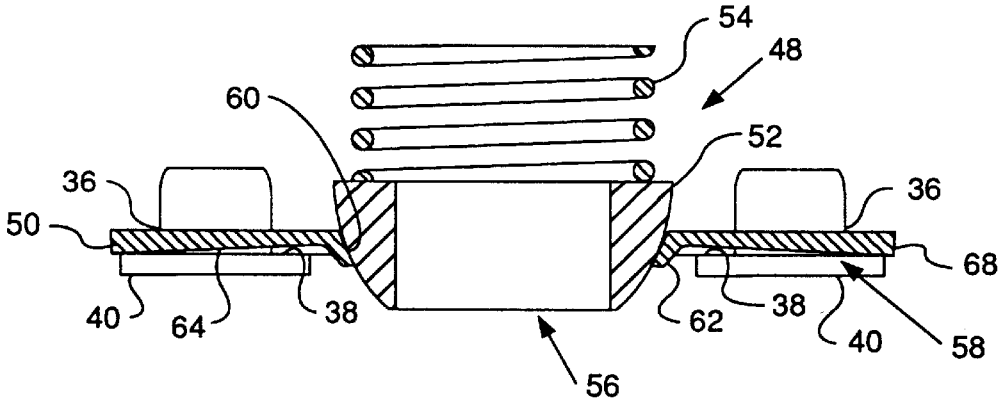
FIG. 5 is a diagrammatic representation of the shoe plate, a biasing mechanism, and a plurality of shoes prior to assembly.

FIG. 5 illustrates the relationship of the force transferring member 52 and the force transferring surface 64 of the shoe plate 50 with the flat bearing surface 38 of the respective shoes 32 prior to assembly of the components into the housing 12.

Figure 6:
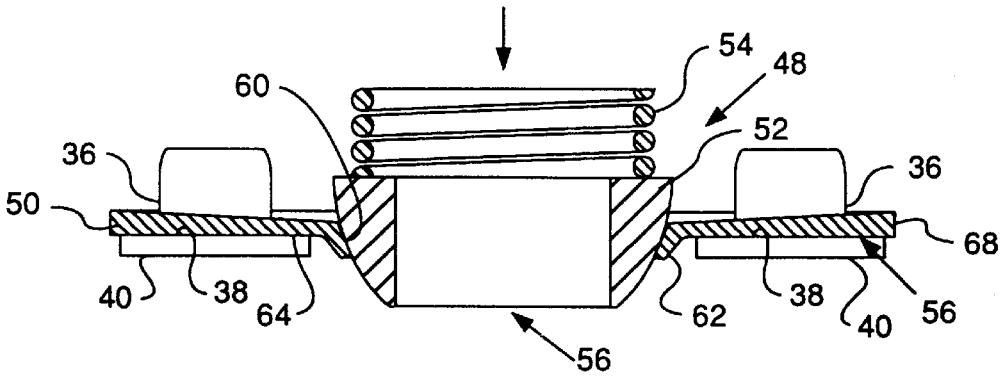
FIG. 6 is a diagrammatic representation of the shoe plate, the biasing mechanism, and the plurality of shoes after assembly.

FIG. 6 illustrates the relationship of the force transferring member 52 and the force transferring surface 64 of the shoe plate 50 with the flat bearing surface 38 of the respective shoes 32 the components are assembled in the housing 12.

Industrial Applicability

During assembly, the spring 54 transfers force through the force transferring member 52 to the inner portion 56 of the shoe plate 50. As the force increases, the shape of the force transferring surface 64 changes from a frusto-conical shape to a flat shape. Once the full force of the spring 54 has been applied to the shoe plate 50, the shape of the force transferring surface 64 is substantially flat and fully mates with the flat bearing surface 38 of the respective shoes 32. Since the force of the spring 54 exerted during assembly is used to flatten the force transferring surface 64, there is no tendency for the shoe plate 50 to become distorted due to the forces needed to retain the shoes 32 against the swashplate 14. Consequently, the shoes 32 are securely held against the swashplate 14 and the possibility of the shoes 32 tipping is substantially eliminated.

In view of the above, it is readily apparent that the retainer mechanism 20 of the present invention provides an arrangement that is effective to hold the shoes 32 against the circumferential bearing surface 42 of the swashplate 14 and also substantially eliminates the tendency of the shoes 32 to tip relative to the swashplate 14.

Other aspects, objects and advantages of this invention can be obtained from a study of the drawings, the disclosure and the appended claims.

I claim:

1. A retainer mechanism adapted for use in an axial piston machine, the axial piston machine including a housing with a rotatable barrel disposed therein, a swashplate having a circumferential bearing surface, a plurality of shoes each having a substantially flat bearing surface and a sliding surface, and a biasing mechanism, the retainer mechanism being biased against the respective shoes to maintain the sliding surface of the shoes in sliding contact with the circumferential bearing surface of the swashplate, the retainer mechanism comprising:

a shoe plate having a circumferential outer portion and an inner portion, the circumferential outer portion having a force transferring surface on one side and a plurality of openings defined therein, said force transferring surface having a generally frusto-conical shape which is adapted to be biased by the biasing mechanism into a generally flat planar shape, said force transferring surface being adapted to be in intimate contact with substantially all of the flat bearing surface of each of said plurality of shoes when biased by the biasing mechanism.

2. The retainer mechanism of claim 1 wherein the shoe plate is generally circular and has an outermost edge, the thickness of the shoe plate varies from the outermost edge towards the center.

3. The retainer mechanism of claim 2 wherein the shoe plate has the greatest thickness at the outermost edge.

4. The retainer mechanism of claim 3 in combination with the biasing mechanism that includes a force transferring member in intimate contact with the inner portion of the shoe plate and a spring adapted to be disposed between the barrel and the force transferring member.

* * * * *